US007528338B2

(12) United States Patent
Ataka

(10) Patent No.: US 7,528,338 B2
(45) Date of Patent: May 5, 2009

(54) FIXED CONTRACT PATTERN AND SWITCH DEVICE INCLUDING THE SAME

(75) Inventor: Ryuji Ataka, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 12/102,391

(22) Filed: Apr. 14, 2008

(65) Prior Publication Data

US 2008/0283381 A1 Nov. 20, 2008

(30) Foreign Application Priority Data

May 16, 2007 (JP) ..... 2007-130735

(51) Int. Cl.
*H01H 1/10* (2006.01)

(52) U.S. Cl. ..... 200/517; 200/275; 200/292

(58) Field of Classification Search ..... 200/512–513, 200/517, 520, 16 R, 275, 292
See application file for complete search history.

(56) References Cited

U.S. PATENT DOCUMENTS 4,496,803 A * 1/1985 Smith ..... 200/5 A
4,892,981 A * 1/1990 Soloway et al. ..... 200/5 A
5,559,311 A * 9/1996 Gorbatoff ..... 200/513
5,952,629 A * 9/1999 Yoshinaga et al. ..... 200/5 A
6,448,518 B1 * 9/2002 Martin et al. ..... 200/292
6,657,141 B1 * 12/2003 Myojin ..... 200/6 A
7,030,329 B1 * 4/2006 Sneek et al. ..... 200/292

FOREIGN PATENT DOCUMENTS

JP 7-50112 2/1995
JP 8-7690 1/1996
JP 2001-210179 8/2001

* cited by examiner

*Primary Examiner*—Kyung Lee
(74) *Attorney, Agent, or Firm*—Brinks Hofer Gilson & Lione

(57) ABSTRACT

Gaps that divide a conductive portion include an I-shaped gap that passes through the center of a fixed contact, and L-shaped gaps that are located on both sides of the I-shaped gap. Longitudinal gap of the L-shaped gaps extend beyond a virtual straight line A-A that passes through the center of the fixed contact and extend in the direction orthogonal to the I-shaped gap, and are connected to lateral gaps. The L-shaped gaps are arranged point-symmetrically about the center of the fixed contact.

9 Claims, 8 Drawing Sheets

FIXED CONTRACT PATTERN AND SWITCH DEVICE INCLUDING THE SAME

This application claims benefit of Japanese Patent Application No. 2007-130735 filed on May 16, 2007, which is hereby incorporated in its entirety by reference.

BACKGROUND

1. Field of the Invention

The present invention relates to a switch device, such as a mirror switch or a power window switch, which is used in various fields, such as vehicle-mounted apparatuses or various information processing apparatuses, and a fixed contact pattern of the switch device including the same. In addition, particularly, the switch device is a push switch device of a type that shorts a plurality of fixed contacts from each other by a movable contact. More specifically, the present invention relates to a fixed contact pattern and a switch device, capable of reliably shorting fixed contacts from each other even in a case where the movable contact is pushed and touched on a fixed contact in a state where the movable contact is inclined, and particularly, to a fixed contact pattern capable of being miniaturized, and a switch device including the same.

2. Description of the Related Art

Conventionally, a contact pattern having the shape shown in FIG. 12 is suggested as a contact pattern provided on a printed circuit board of a key switch (see, for example Japanese Unexamined Patent Application Publication No. 2001-210179). A contact pattern 100 that becomes the fixed contact has a substantially oblong planar shape, and with an I-shaped first gap 101 extending in the direction of a minor axis as a center, substantially V-shaped second gaps 102 are provided on both sides of the first gap, and substantially U-shaped third gaps 103 are provided on both sides of the first gap. Also, six conductive layers 104*a*-104*f* are formed so as to be filled between the gaps 101 to 103.

Among the six conductive layers 104*a* to 104*f*, for example, the conductive layers 104*a*, 104*c*, and 104*e* are electrically connected, and the conductive layers 104*b*, 104*d*, and 104*f* are electrically connected. Also, a group of the former conductive layers 104*a*, 104*c*, and 104*e*, and a group of the latter conductive layers 104*b*, 104*d*, and 104*f* are electrically insulated from each other by the gaps 101 to 103.

When, for example, a left end of a conductive movable contact (not shown) that has a substantially oblong planar shape similarly is pressed against the contact pattern 100, the conductive layer 104*b* and the conductive layer 104*c* are electrically connected via the movable contact, and both groups are shorted from each other by the movable contact, and thus, an ON signal is output from a key switch.

In addition, as this type of contact pattern, those described in Japanese Unexamined Patent Application Publication Nos. 7-50112 and 8-7690

Meanwhile, in the contact pattern 100 shown in FIG. 12, when a distance θ3 from one open end of the first gap 101 to one open end of the second gap 102 and a distance θ4 from one open end of the second gap 102 to the other open end thereof are compared with each other, the distance θ4 is quite longer than the distance θ3 (θ3<<θ4). If there are no conductive layer 104*c* which are not electrically connected the conductive layer 104*b* and no gap 103, in the course of this distance θ4, even if the left end of the conductive movable contact is pressed as mentioned above, this cannot be detected, which becomes a non-sensitive region.

In order to avoid this, it is necessary to provide the inverted U-shaped third gap 103, and the conductive layer 104*c* surrounded by the gap, near the left end of the contact pattern 100. This is also the same near a right end of the contact pattern 100. Ultimately, the whole contact pattern 100 needs five gaps 101 to 103 and six conductive layers 104*a* to 104*f* in total. As a result, there is a drawback that the pattern become complicated, and large-sized.

SUMMARY

A fixed contact pattern in which a conductive portion constituting a fixed contact is divided by a plurality of gaps. The gaps include an I-shaped gap that passes through the center of the fixed contact and that has open ends, which are open towards both sides of the fixed contact, at both ends thereof, and L-shaped gaps formed by connecting longitudinal gaps that are located on both sides of the I-shaped gap and extend substantially parallel to the I-shaped gap, and lateral gaps that extend in a direction orthogonal to the longitudinal gaps. The longitudinal gaps extend beyond a virtual straight line A-A that passes through the center of the fixed contact and extend in the direction orthogonal to the I-shaped gap, and are connected to the lateral gaps. The L-shaped gaps are arranged point-symmetrically about the center of the fixed contact.

DESCRIPTION OF THE EMBODIMENTS

Figure 1:
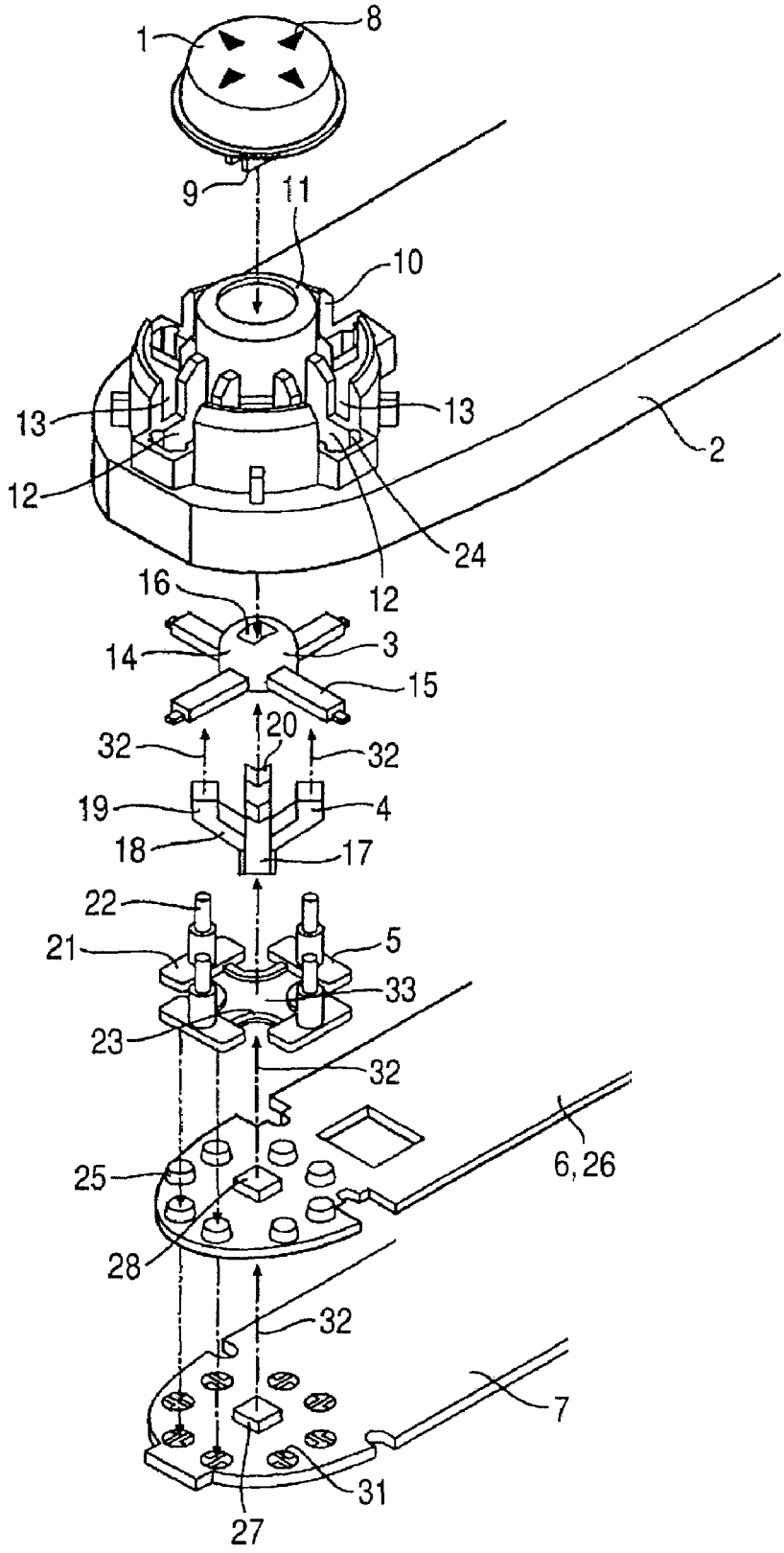
FIG. 1 is an exploded perspective view of a vehicle-mounted mirror switch according to a first embodiment.

Next, embodiments of the invention will be explained with reference to the drawings. FIG. 1 is an exploded perspective view of a vehicle-mounted mirror switch according to a first embodiment. This mirror switch is mainly composed of an upper operating body 1, an inside casing 2 (casing), a lower operating body 3, a light guide body 4, a switch driving body 5, an elastic sheet 6, a printed circuit board 7, and an outside casing (not shown).

The upper operating body 1 has a substantially hat-like profile, and has a plurality of (four in this embodiment) indicating portions 8 provided in the vicinity of an outer periphery of a top surface thereof. The indicating portions 8 have an arrow shape so as to indicate the movement direction of a mirror. An operator depresses the indicating portions 8 (pressing portions) with his/her finger so as to move a mirror in a desired direction, and each indicating portion 8 has transparency so that the light from the lower can be transmitted. Further, a pawl-like engaging projection 9 that split into two is formed in the center of a bottom surface of the upper operating body 1.

Eight supporting and guiding portions 10 are provided so as to protrude from the top surface of the inside casing 2. The internal space of the inside casing 2 has almost the same shape as the elastic sheet 6 or the printed circuit board 7, and houses the lower operating body 3, the light guide body 4, the switch driving body 5, the elastic sheet 6, and the printed circuit board 7. A lower end opening of the inside casing is closed by the printed circuit board 7. In addition, although illustration is omitted, the upper and lower casings are provided, and parts excluding the upper operating body 1 are housed.

A tubular portion 11 in which the engaging projection 9 of the upper operating body 1 is inserted is provided in a central position of the eight supporting and guiding portions 10. At an outer peripheral portion of the tubular portion 11, a plurality of (four in this embodiment) operating-body guiding portions 12 having a groove-like planar shape, and a plurality of (four in this embodiment) light-guide-body guide portions 13 are formed alternately along in a peripheral direction. The respective guide portions 12 and 13 are formed from the top surface of the inside casing 2 through the inside thereof, and are partitioned by the supporting and guiding portions 10.

The lower operating body 3 is composed of a substantially spherical sphere portion 14 that is provided in a central portion thereof, and operating bars (four in this embodiment) 15 that radically extend at regular intervals in a horizontal direction about the sphere portion 14. A recess 16 in which the engaging projection 9 of the upper operating body 1 is snapped is formed in a central top surface of the sphere portion 14. As the engaging projection 9 and the recess 16 are snappingly coupled together, the upper operating body 1 and the lower operating body 3 constitute an operating body that operates integrally. The surface of the tubular portion 11 that faces the sphere portion 14 is formed with a receiving portion (not shown) having a shape corresponding to the shape of the sphere portion. As the tubular portion 11 is sandwiched between the upper operating body 1 and the lower operating body 3, the operating body is tiltablity held with the center of the sphere portion 14 as a tilting center O (refer to FIG. 11).

The lower operating body 3 is inserted into the supporting and guiding portions 10 from the bottom of the inside casing 2, the sphere portion 14 is housed inside the tubular portion 11, and the operating bars 15 are housed inside the operating-body guiding portions 12 so that it can move up and down (tilt). The inner surface of the tubular portion 11 is formed so as to conform to the sphere portion 14, and the engaging projection 9 of the upper operating body 1 is snapped (snap coupling) in the recess 16 of the sphere portion 14 in a state where the inner surface of the tubular portion 11 touches the sphere portion 14, and thereby, the operating body (a combination of the upper operating body 1 and the lower operating body 3) is held in the inside casing 2 so as to be tiltable in a direction in which the operating bars 15 extend.

The light guide body 4 is injection-molded of, for example, transparent synthetic resin, such as acrylic resin, and integrally has a central base portion 17, a plurality of light guide portions (four in this embodiment) 18 that spread obliquely upward and extends at equal intervals from the central base portion 17, and light emission portions 19 that extend in a vertical direction upward from each light guide portion 18. A convex lens portion (not shown) is integrally formed in a central portion of a bottom surface of the central base portion 17, and a V-groove surface 20 is provided in a top surface of each of the light emission portions 19 so that the light from the light emission portion 19 may not be emitted immediately upward, but emitted in an oblique direction.

The light guide body 4 is inserted into the inside casing 2 from the bottom of the lower operating body 3, and the light emission portions 19 are mounted into the light-guide-body guide portions 13, respectively, without chattering, and are supported by the inside casing 2 (supporting and guiding portions 10). Each indicating portion 8 of the upper operating body 1 and each operating bar 15 of the lower operating body 3 coincide with each other in the vertical direction so that the switch can be turned on in a direction in which an operator is going to operate. Therefore, light is radiated from the bottom of one indicating portion 8 by providing the V-groove surface 20 in the top surface of the light emission portion 19, and emitting light from the adjacent light emission portion 19.

The switch driving body 5 is composed of a plurality of (four in this embodiment) rectangular parallelepipeds 21, a pressing pin 22 provided integrally in the center of a top surface of each of the rectangular parallelepipeds 21, and a connecting portion 23 that connects the rectangular parallelepipeds 21 together and that is thin and substantially circular-arc-shaped in planar shape. The plurality of rectangular parallelepipeds 21 can be handled as one part at the time of assembling by the coupling of the connecting portion 23, which is convenient, and the length and elastic force of the connecting portion 23 are designed so that the rectangular parallelepipeds 21 can operate independently from each other without interference at the time of operation (pressing) of the switch.

In this embodiment, the longitudinal direction of two rectangular parallelepipeds 21 that face each other among the four rectangular parallelepipeds 21 turns to an X-direction, and the longitudinal direction of the two remaining rectangular parallelepipeds 21 that face each other turns to a Y-direction that is orthogonal to the X-direction.

Figure 2:
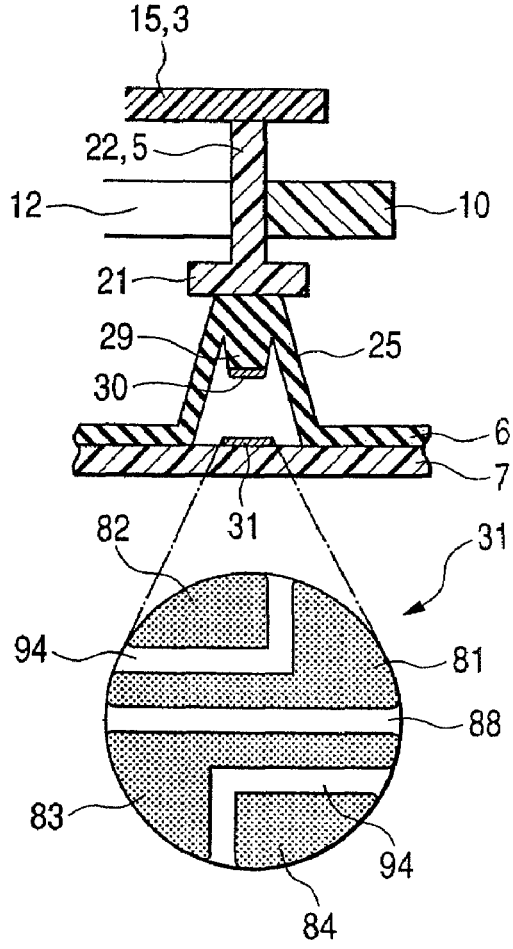
FIG. 2 is a sectional view showing a state (standby state) before the switch is operated.

The switch driving body 5 is inserted into the supporting and guiding portions 10 from the bottom of the light guide body 4, and each of the pressing pins 22 pass along the inside of a circular-arc shaped groove 24 connected to an outside front end of each of the operating-body guiding portions 12 in the supporting and guiding portions 10, and as shown in FIG. 2, contacts the bottom surface of each of the operating bars 15 of the lower operating body 3. The circular-arc-shaped groove 24 serves as a support and a guide of vertical movement for each of the pressing pins 22, and thereby, the switch driving body 5 is held in a predetermined position.

The elastic sheet 6 is made of an elastic body having pliability, such as rubber, and (a total of eight) bulging portions 25 in which two adjacent bulging portions become one set are provided in a plurality of sets (four sets in this embodiment) integrally with the sheet base 26 in positions where a set of bulging portions face both ends of each of the rectangular parallelepipeds 21 of the switch driving body 5. A protective salient portion 28 that protects an LED 27 to be described later is formed integrally with the sheet base 26 almost in a central position of a group of the bulging portions 25.

As shown in FIG. 2, each of the bulging portions 25 is hollow, and is substantially trapezoidal in sectional shape. A protruding portion 29 that protrudes slightly downward is formed in the center of the bottom surface of each bulging portion, and a movable contact 30 that is circular in planar shape is attached to the bottom surface of the protruding portion 29. Although the bottom surface of the movable contact 30 is formed as a flat surface with no irregularities, the bottom surface may be formed with irregularities by providing a plurality of grooves, or the like. That is, it is sufficient if the bottom surface of the movable contact 30 is a substantially flat surface.

A fixed contact 31 that is substantially circular in planar shape is formed in a position where it faces each movable contact 30 on the top surface of the printed circuit board 7, and the fixed contact 31 has a larger diameter than the movable contact 30 (refer to FIG. 10). Further, the LED 27 is mounted almost in the central position of a group of the fixed contacts 31. In FIG. 2, the direction of a pattern (to be described later) of the fixed contact 31 is shown in an enlarged manner for reference. The elastic sheet 6 is inserted into a lower end opening of the inside casing 2 with the printed circuit board 7 covered.

In this way, the inside casing 2 into which the upper operating body 1, the lower operating body 3, the light guide body 4, the switch driving body 5, the elastic sheet 6, and the printed circuit board 7 are assembled is housed in the outside casing that is split into two upper and lower pieces, and the top surface of the upper operating body 1 is exposed from the top surface of the outside casing.

As shown in FIG. 1, light 32 emitted from the LED 27 is transmitted through the protective salient portion 28 of the elastic sheet 6, passes through an inside space 33 of the switch driving body 5, enters a convex lens portion (not shown) of the bottom surface of the light guide body 4, is branched to each light guide portion 18, and is emitted from the V-groove surface 20 of the light emission portion 19 to illuminate each indicating portion 8 of the upper operating body 1 from the bottom. This allows each indicating portion 8 (pressing portion) to be clearly indicated even in a dark vehicle room.

Next, the general operation of this mirror switch will be explained. FIG. 2 is a sectional view showing a state (standby state) before the switch is operated. As shown in this drawing, in the standby state, a bulging portion 25 is erected, and a movable contact 30 is separated from a fixed contact 31. The switch driving body 5 (pressing pin 22) on the bulging portion 25 is also in an erected state, and an operating bar 15 of the lower operating body 3 becomes horizontal, and rides on the switch driving body 5 (pressing pin 22).

Figure 3:
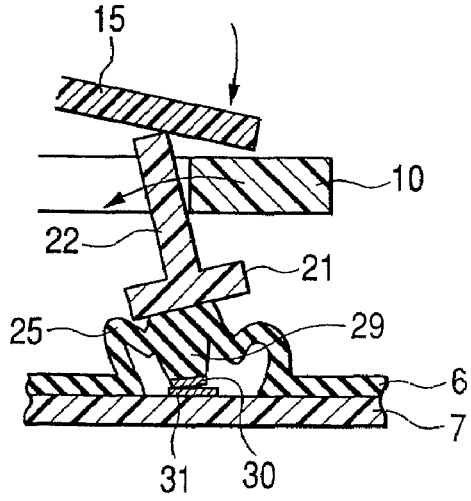
FIG. 3 is a sectional view showing a state while the switch is operated.

If an operator pushes a desired indicating portion 8 of the upper operating body 1 in order to move a mirror, the whole operating body (a combined body of the upper operating body 1 and the lower operating body 3) is tilted in a push direction about the tilting center o (refer to FIG. 11). This state is shown in FIG. 3, and a front end of the operating bar 15 descends with the tilting of the operating body. Thereby, the switch driving body 5 is pressed down, the bulging portion 25 is crushed by the pressing force of the switch driving body 5, the movable contact 30 contacts the fixed contact 31, and a conductor on the fixed contact 31 (to be described later) is shorted electrically, thereby outputting an ON signal.

At the time of the operation of this switch, the operating bar 15 rotates about the tilting center O, and with the rotation of the operating bar, the switch driving body 5 (pressing pin 22) is basically guided by the circular-arc-shaped groove 24 to move in the vertical direction. However, since the hollow operating-body guiding portion 12 is formed in the extension direction of the operating bar 15, it is difficult to perform sufficient guiding by the circular-arc-shaped groove 24. Accordingly, as actually shown by an arrow, the upper portion of the operating body tends to fall in the central direction. In many cases, a rectangular parallelepiped 21 of the switch driving body 5 obliquely pushes the bulging portion 25 by the tilting of the switch driving body 5, which is extremely shown in FIG. 3, but the end push of the fixed contact 31 is apt to occur frequently.

In addition, although the circular-arc-shaped groove 24 is provided in this embodiment, it can also be applied to a round guide. That is, even in this case, in order to form a slight gap with the switch driving body for convenience of guiding the switch driving body in the vertical direction, the same phenomenon occurs.

If a finger is released from the indicating portion 8, the operating bar 15 is pushed up via the switch driving body 5, and returns automatically to the standby state shown in FIG. 2, by a restoring force of the bulging portion 25.

Figure 4:
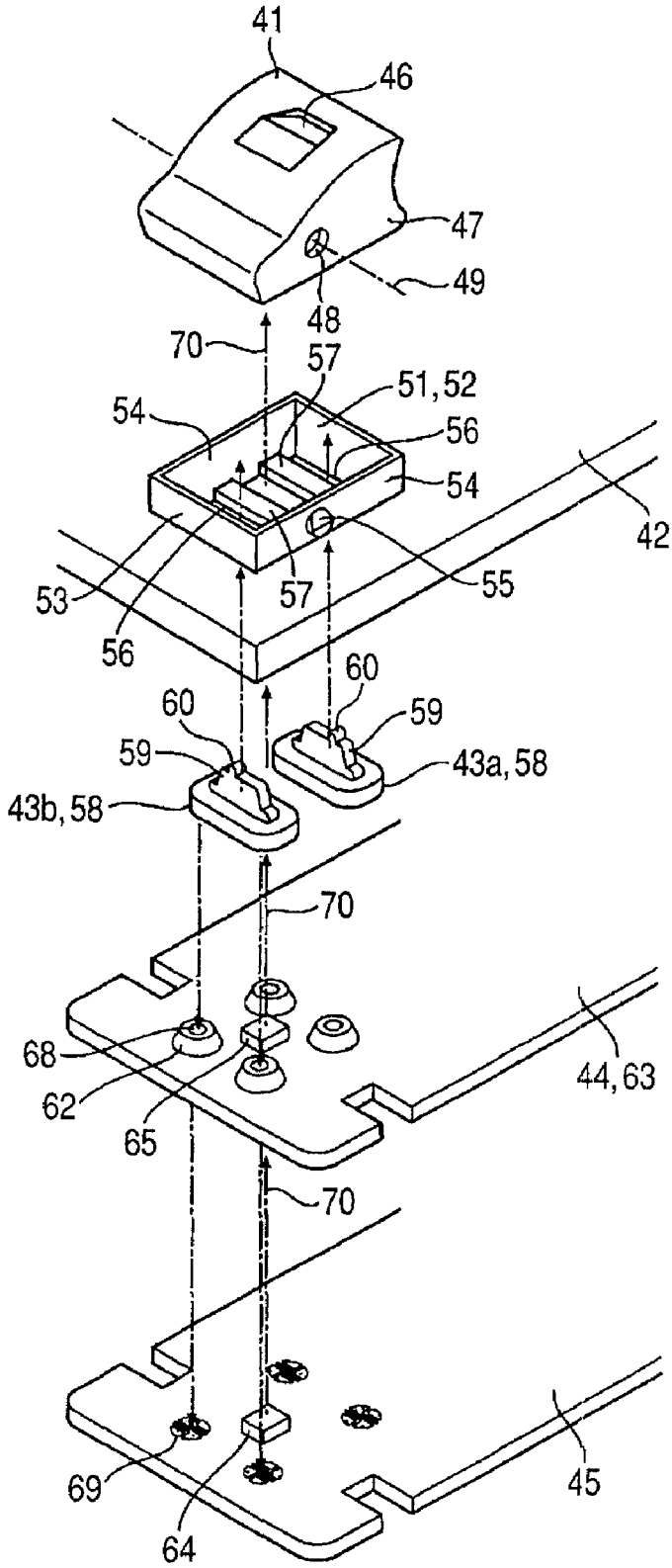
FIG. 4 is an exploded perspective view of a power window switch according to a second embodiment of the invention.

FIG. 4 is an exploded perspective view of a power window switch according to a second embodiment. This power window switch is mainly composed of an operating body 41, an inside casing 42, a switch driving body 43, an elastic sheet 44, a printed circuit board 45, and an outside casing (not shown).

Figure 5:
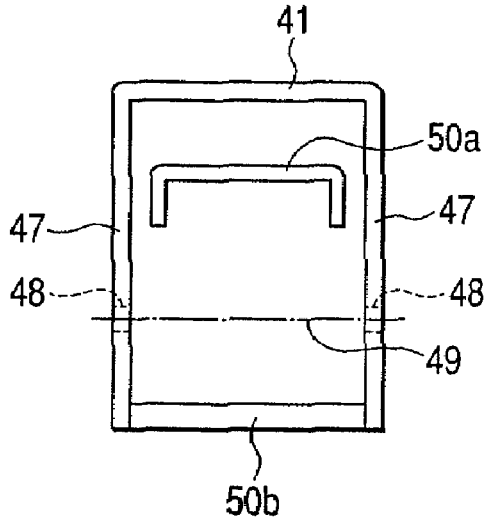
FIG. 5 is a bottom view of an operating body used for the switch.

The top surface of the operating body 41 is provided with an indicating portion 46 formed by designing a window, and the indicating portion 46 has transparency so that the light from the bottom can be transmitted. FIG. 5 is a bottom view of the operating body 41, and a pair of holes 48 and 48 are formed in both side walls 47 and 47 of the operating body 41. Further, two pressing portions 50 are formed parallel to an axis 49 of a pair of the holes 48 and 48 before and behind the axis with the axis 49 therebetween.

A supporting portion 51 having almost the same size as the inside of the operating body 41 is provided on the top surface of the inside casing 42 so as to protrude therefrom, and the supporting portion 51 has a front wall 52, a back wall 53, and opposite side walls 54, and has a rectangular shape in planar shape. A pair of pivots 55 are provided in the opposite side walls 54. By inserting the pivots 55 into the holes 48 formed in the opposite sides walls 47 of the operating body 41, the operating body 41 is supported so that it can make a seesaw movement with the pivots 55 as the center of rotation. In this embodiment, the holes 48 are provided in the operating body 41, and the pivots 55 are provided in the supporting portion 51. However, the pivots 55 may be provided in the operating body 41, and the holes 48 may be provided in the supporting portion 51. Further, the holes 48 are not necessarily through holes.

Supporting ribs 57 are constructed parallel to the front wall 52 and the back wall 53 inside the front wall 52 and the back wall 53 with gaps 56 in order to insert and support an upper portion of the driving body 43. A lower opening of the inside casing 42 has the same shape as the elastic sheet 44 and the printed circuit board 45.

The switch driving body 43 is arranged in two in the front-back direction, and each of the switch driving bodies 43*a* and 43*b* has a base portion 58 that is substantially oblong in planar shape, an upright wall portion 59 that is erected upward from the base portion 58, one receiving projection 60 formed at an upper end of the upright wall portion 29, and two insertion projections 61 formed near both ends of the bottom surface of the base portion 58.

The elastic sheet 44 is made of an elastic body having pliability, such as rubber, and (a total of four) bulging portions 62 in which two adjacent bulging portions become one set are provided in a plurality of sets (two sets in this embodiment) integrally with the sheet base 63 so that they may face each other with predetermined spacing. A protective salient portion 65 that protects an LED 64 to be described later and ensures the water-proofness and dust-proofness of the printed circuit board 45 is formed integrally with the sheet base 63 almost in a central position of a group of the bulging portions 62.

Figure 6:
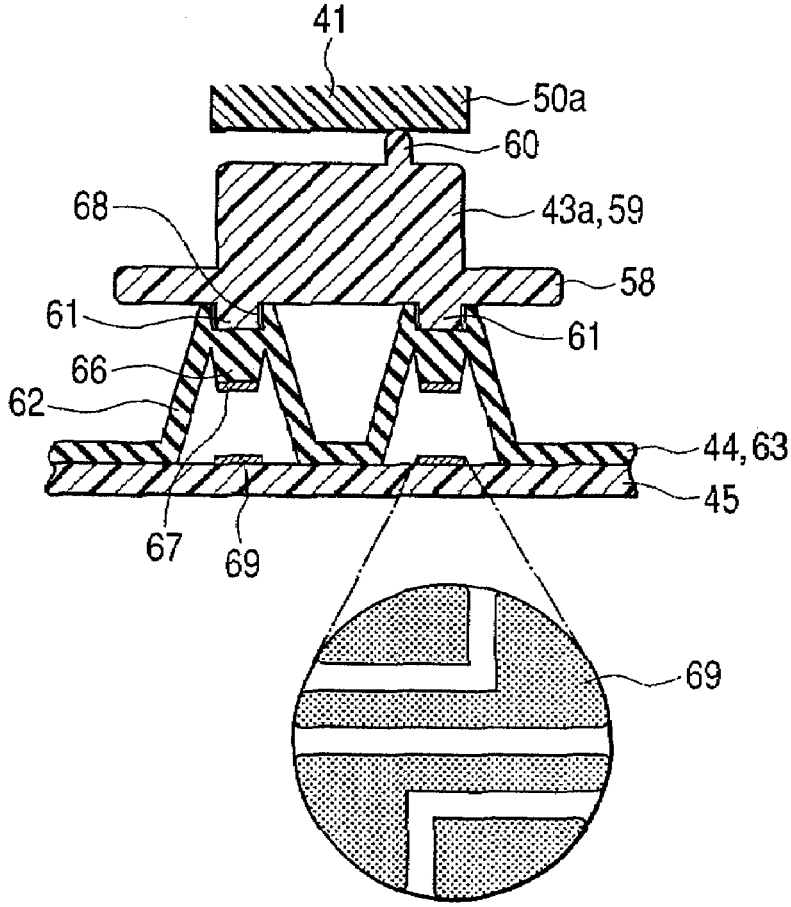
FIG. 6 is a sectional view showing a state (standby state) before the switch is operated.

As shown in FIG. 6, each of the bulging portions 62 is hollow, and is substantially trapezoidal in sectional shape. A protruding portion 66 that protrudes slightly downward is formed in the center of the bottom surface of each budging portion, and a movable contact 67 that is circular in planar shape is attached to the bottom surface of the protruding portion 66. Further, a recess 68 into which one insertion projection 61 of the switch driving body 43 is inserted elastically is formed in the top surface of the bulging portion 62. The spacing between the recesses 68 in one set of adjacent bulging portions 62 is designed so as to be equal to the spacing between the insertion projections 61 of one switch driving body 43.

As shown in FIG. 6, a fixed contact 69 that is substantially circular in planar shape is formed in a position where it faces each movable contact 67 on the top surface of the printed circuit board 45. Further, the LED 64 is mounted almost in the central position of a group of the fixed contacts 69.

By covering and protecting the top surface of the printed circuit board 45 with the elastic sheet 44, and press-fitting both the insertion projections 61 of the switch driving body 43 into the recesses 68 of one set of adjacent bulging portions 62 in the elastic sheet 44, each switch driving body 43 is held in a state of being erected on the elastic sheet 44.

In this way, at the time of assembling, the switch driving body 43 can be easily assembled without falling into pieces separately, and the positional deviation of the switch driving body 43 in the direction of the axis 49 (refer to FIG. 4) can be prevented. As will be described later, during the operation of the switch, the switch driving body 43 is inclined and pressed due to the existence of the receiving projection 60 that has been biased, and thereby, the force that is going to shift the switch driving body in the direction of the axis 49 acts on the switch driving body 43. The engagement between the insertion projections 61 and the recesses 68 can effectively prevent the positional deviation of the switch driving body 43.

On the other hand, the engagement between the holes 48 and the pivots 55 allows the operating body 41 to be supported by the supporting portion 51 of the inside casing 42 that the operating body can rotate (make a seesaw movement) within a predetermined range.

By inserting the printed circuit board 45 holding the elastic sheet 44 and the two switch driving bodies 43*a* and 43*b* from the lower end opening of the inside casing 42, the upper portions of the two switch driving bodies 43*a* and 43*b* are inserted into gaps 56 and 56 formed in the supporting portion 51 of the inside casing 42, thereby preventing falling of the switch driving bodies 43*a* and 43*b* at the time of pressing.

By completely inserting the printed circuit board 45 into the lower end opening of the inside casing 42, as shown in FIG. 6, the receiving projection 60 of the switch driving body 43 abuts on the bottom surfaces of the pressing portions 50 provided in the operating body 41.

In this embodiment, two switch driving bodies 43 are provided, the receiving projection 60 of one switch driving body 43*a* is biased to the right of an intermediate position of the movable contacts 67 and 67 as shown in FIG. 6, and the receiving projection 60 of the other switch driving body 43*b* is biased to the left of the intermediate position of the movable contacts 67 and 67 (refer to FIG. 4). The receiving projection 60 of one switch driving body 43*a* abuts on the pressing portion 50*a* shown in FIG. 5, and the receiving projection 60 of the other switch driving body 43*b* abuts on the pressing portion 50*b*. Also, one switch driving body 43*a* operates when a window of a vehicle is opened, and the other switch driving body 43*b* when the window of the vehicle is closed.

As mentioned above, the position of the receiving projection 60 of the switch driving body 43 is shifted from the intermediate position between the movable contacts 67. This is provided to construct a two-stage switch, the details of which will be explained later.

In this way, the intermediate casing 42 into which the operating body 41, the switch operating body 43, the elastic sheet 44, and the printed circuit board 45 are assembled is housed in the outside casing that is split into two upper and lower pieces, and the top surface of the operating body 41 is exposed from the top surface of the outside casing.

The light 70 emitted from the LED 64 is transmitted through the protective salient portion 65 of the elastic sheet 44, passes between the two switch driving bodies 43, passes through between the two supporting ribs 57 of the supporting portion 51, and illuminates the indicating portion 46 of the operating body 41 from the bottom.

Figure 7:
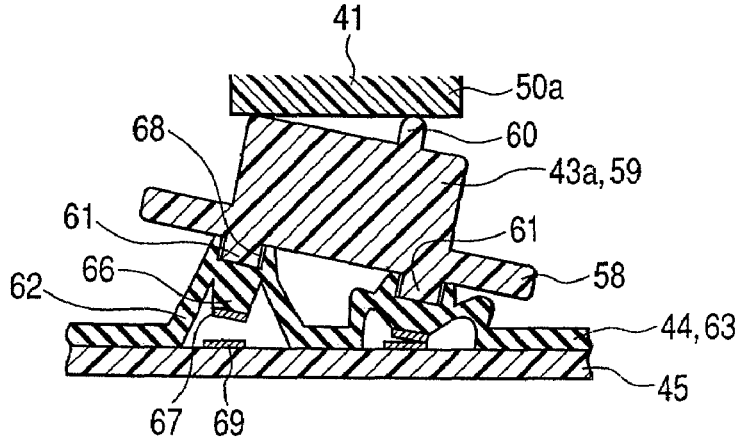
FIG. 7 is a sectional view showing the state of the switch at a first stage where the switch is pressed.
Figure 8:
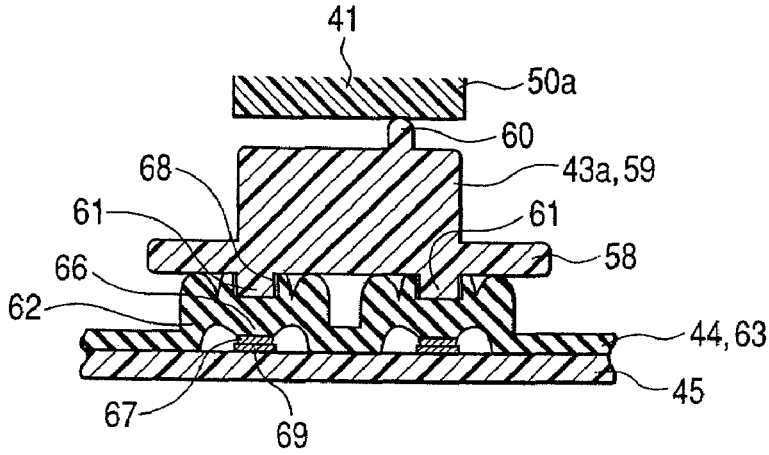
FIG. 8 is a sectional view showing the state of the switch at a second stage where the switch is pressed.

Next, the general operation of this power window switch will be explained. FIG. 6 is a sectional view showing a standby state where the switch is not pressed, FIG. 7 is a sectional view showing the state of the switch at a first stage where the switch is pressed, and FIG. 8 is a sectional view showing the state of the switch at a second stage where the switch is pressed consecutively. In addition, in FIG. 6, the direction of a pattern of the fixed contact 69 is shown in an enlarged manner for reference.

As shown in FIG. 6, in the standby state of the switch, the switch driving body 43*a* is horizontally lifted by the elastic force of the two bulging portions 62 in the elastic sheet 44, and the receiving projection 60 provided in the switch driving body 43*a* elastically contacts the pressing portion 50*a* of the operating body 41, thereby forming a gap between the top surface of the switch driving body 43*a* other than the receiving projection 60, and the bottom surface of the pressing portion 50*a*. Further, the two movable contacts 67 are separated at predetermined spacing from the corresponding fixed contacts 69, and the power window switch is turned off accordingly.

When the rear end of the operating body 41 is lifted to rotate the operating body 41 clockwise about the axis 49, the pressing portion 50*a* (refer to FIG. 5) presses the switch driving body 43*a* with the rotation. Since the receiving projection 60 provided on the top surface of the switch driving body 43*a* is provided in a biased position, the switch driving body 50*a* inclines as shown in FIG. 7 due to a difference in moment by pushing the receiving projection 60.

Due to this inclination, the bulging portion 62 closer to the receiving projection 60 is buckled by elastic deformation. As a result, the movable contact 67 held by the bulging portion 62 contacts the fixed contact 69 that faces it.

The other bulging portion 62 located in a line with this bulging portion 62 slightly elastically deforms as the switch driving body 43*a* inclines. However, the movable contact 67 held by the bulging portion 62 does not contact the fixed contact 69 that faces it, and thereby a detection signal is eventually output from one switch. The state shown in FIG. 7 is an ON state of the switch at a first stage. In this embodiment, this becomes a manual power window operation (ascent of a windowpane).

Subsequently, when the switch driving body 43*a* is pressed by the pressing portion 50*a*, as shown in FIG. 8, the other bulging portion 62 is also buckled. As a result, the movable contact 67 held by the bulging portion 62 also contacts the fixed contact 69 that faces it, and thereby, detection signals are output from both the switches. The state shown in FIG. 8 is an ON state of the switch at a second stage. In this embodiment, this becomes an automatic power window operation (ascent of a windowpane).

When a hand is released from the operating body 41, the switch driving body 43*a* is lifted by the restoring force of the bulging portion 62 that has deformed electrically, and returns to the standby state of FIG. 6.

When the front end of the operating body 41 is lifted to rotate the operating body 41 counterclockwise about the axis 49, the pressing portion 50*b* (refer to FIG. 5) presses the switch driving body 43*b*.

Depending on the degree of this pressing, one bulging portion 62 is buckled, resulting in an ON state (manual power window operation: descent of a windowpane) of the switch at a first stage where a detection signal is output from one switch, or both the bulging portions 62 are buckled, resulting in an ON state (automatic power window operation: descent of the windowpane) of the switch at a second stage where detection signals are output from both the switches.

Figure 9:
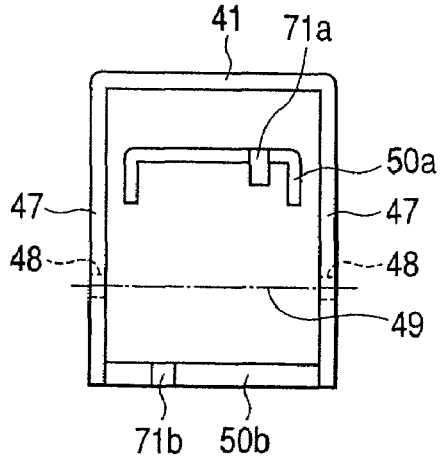
FIG. 9 is a bottom view showing a modified example of the operating body.

FIG. 9 is a bottom view showing a modified example of the operating body 41. As shown in this figure, pressing projections 71*a* and 71*b* are provided in two pressing portions 50*a* and 50*b*, respectively, and the projection 60 is not formed on the top surface of each of the switch driving bodies 43*a* and 43*b*. The positions of the pressing projections 71*a* and 71*b* are shifted in directions opposite to each other from the center of the operating body 41 in its width direction. Since the function of the pressing projections 71*a* and 71*b* is the same as the projection 60, the description of the switching operation is omitted.

In this embodiment, a case where the front end and rear end of the operating body 41 move up and down in opposite directions about the axis 49 (seesaw movement) has been described. However, it is not necessary to provide the rotation center of the operating body in an intermediate portion of the operating body. For example, if a link mechanism or the like is used, the same operation as the above embodiment can be performed even if the rotation center of the operating body is provided at the front end or rear end of the operating body.

In the above embodiment, an example in which the receiving projection 60 is provided in a biased position of the top surface of the switch driving body 43 in order to tilt the switch driving body 43 at the time of switching operation has been described. However, the receiving projection may be provided in the pressing portions 50*a*. That is, it is sufficient if the portions of the switch driving body 43 corresponding to the positions biased from the intermediate position of one pair of the movable contacts 67 can be pushed by the operating body 41. Further, the same operation as the above embodiment can be performed by making the buckling strengths of one set of adjacent bulging portions 62 of the elastic sheet 44 different from each other, for example, by changing wall thickness so that one bulging portion 62 may be buckled earlier than the other bulging portion 62, instead of providing the receiving projection 60.

Figure 10A:
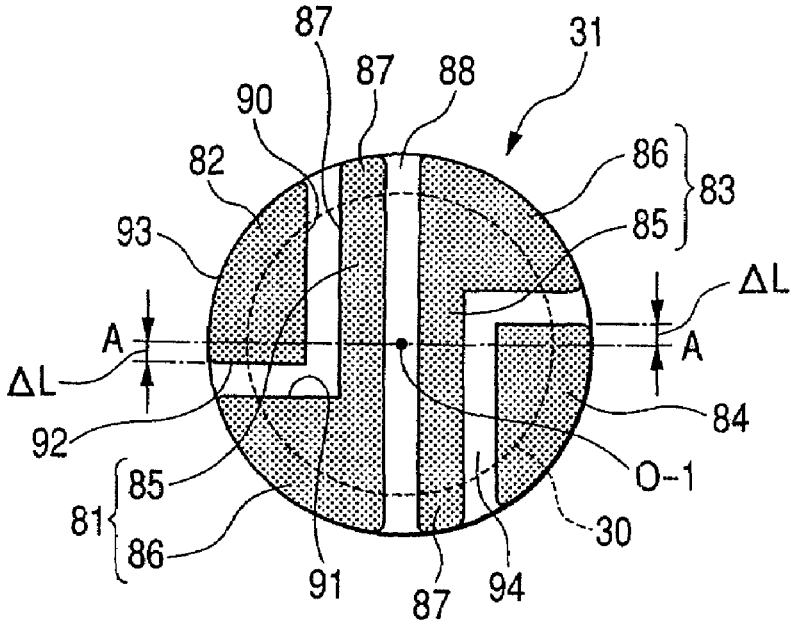
FIGS. 10A and 10B are views showing the shape pattern of a fixed contact.
Figure 10B:
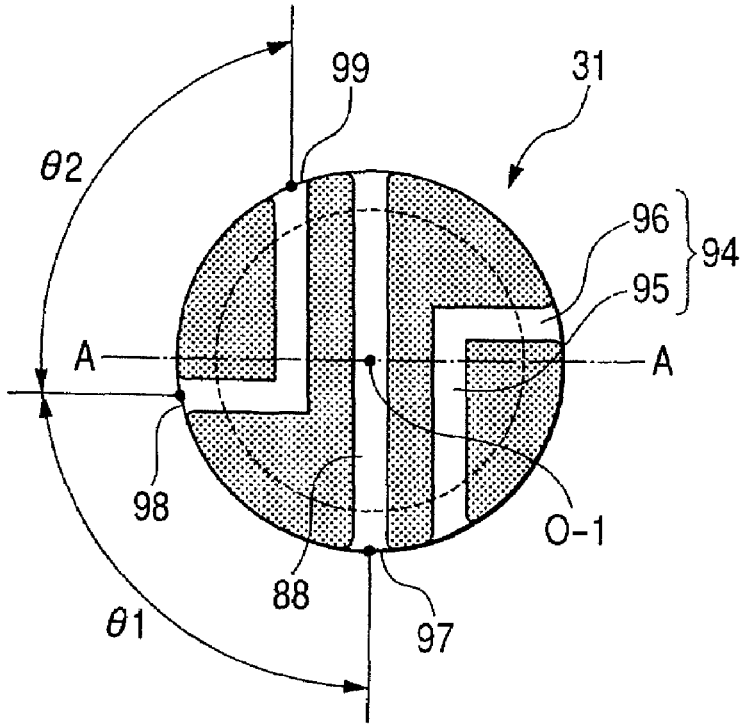
Figure 11B:
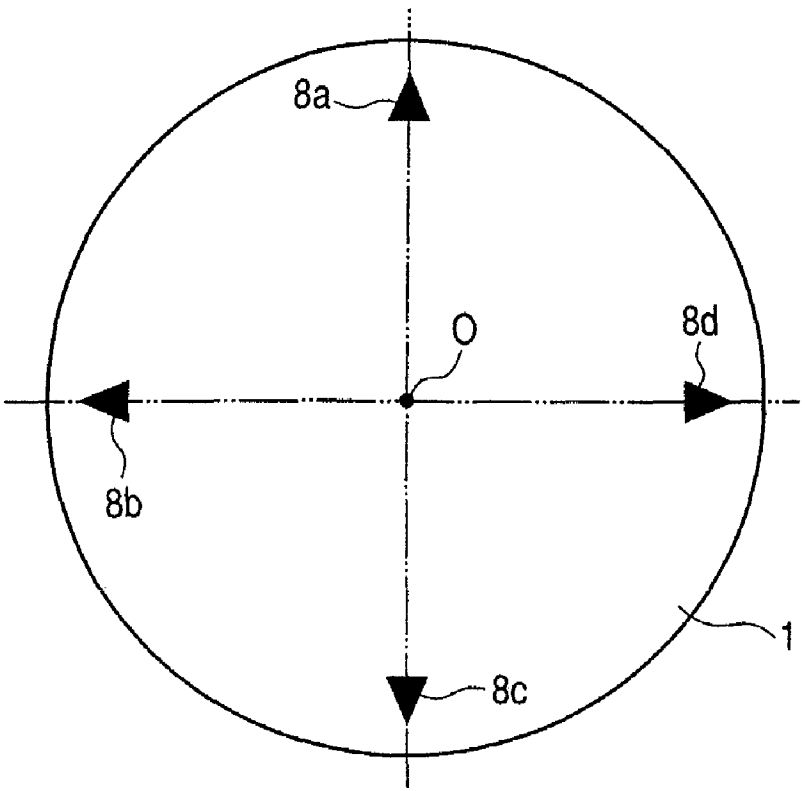
FIGS. 11A and 11B are views showing the arrangement pattern of individual fixed contacts.
Figure 11A:
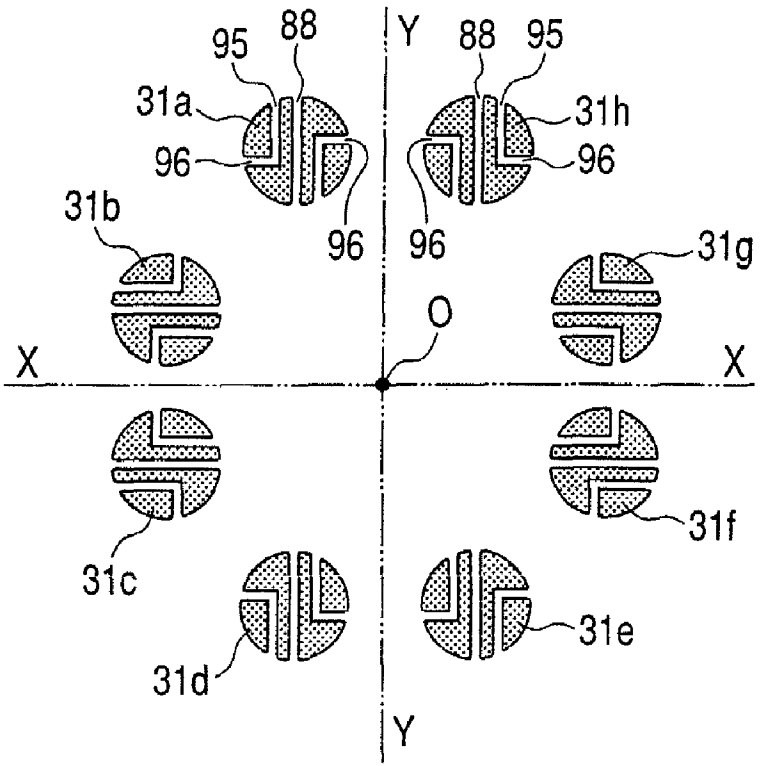
Figure 12:
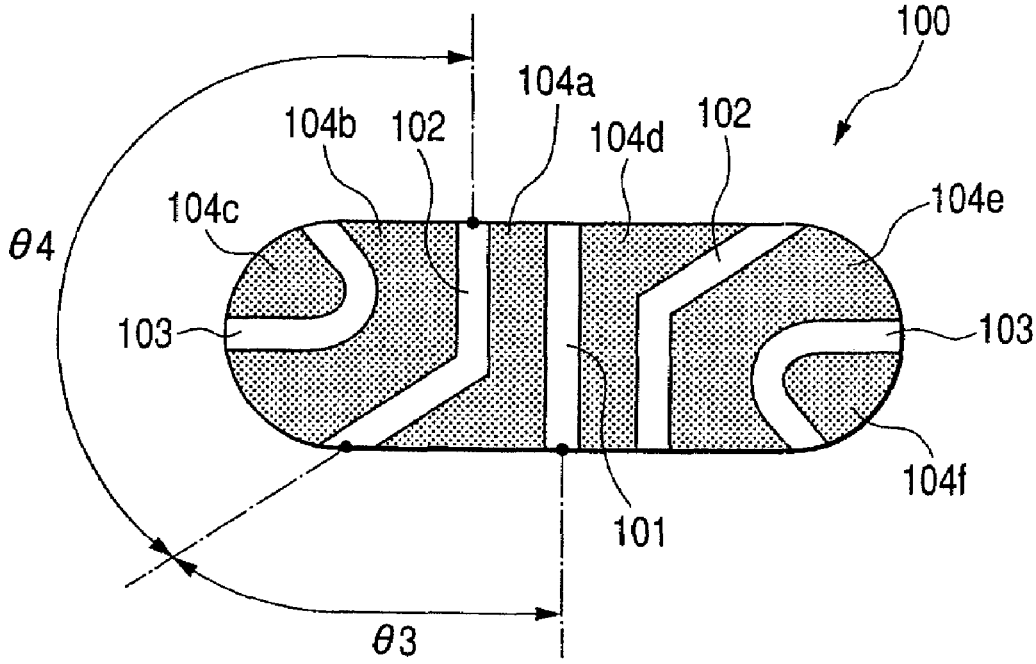
FIG. 12 is an explanatory view of a contact pattern that is conventionally suggested.

Next, the shape and arrangement of the fixed contacts 31 (69) that are used for the above-mentioned mirror switch or power window switch will be explained below. FIGS. 10A and 10B are views showing the shape pattern of a fixed contact, and FIGS. 11A and 11B are views showing the arrangement pattern of the individual fixed contacts 31. In addition, although the fixed contacts are drawn in FIG. 10 that is divided into FIG. 10A and FIG. 10B, this is to avoid complicatedness of the drawings by reference numerals, and the fixed contacts are actually one fixed contact.

In this embodiment, as shown in FIG. 10A, the planar shape of the whole fixed contact 31 is circular, and the conductive portion of the fixed contact 31 is divided into four conductive portions including a first conductive portion 81 to a fourth conductive portion 84. Among them, the first conductive portion 81 and the third conductive portion 83 have the same shape, and are arranged point-symmetrically about a contact center O-1, and the second conductive portion 82 and the fourth conductive portion 84 have the same shape, and are arranged point-symmetrically about the contact center O-1.

The first conductive portion 81 of the third conductive portion 83 have a straight portion 85 that extends substantially radically of the fixed contact 31, and a protruding portion 86 that is formed integrally with the straight portion. One end of the straight portion 85 is formed with the protruding portion 86 that protrudes in a direction orthogonal to a longitudinal direction of the straight portion 85, and whose outer periphery becomes circular-arc-shaped along an outer periphery of the fixed contact 31, and the other end 87 of the straight portion 85 extends to the outer periphery of the fixed contact 31.

The first conductive portion 81 and the third conductive portion 83 are arranged point-symmetrically about the contact center O-1 with an I-shaped gap 88 passing through the contact center O-1 and having almost the same diameter as the diameter of the fixed contact 31 therebetween.

The second conductive portion 82 and the fourth conductive portion 84 is surrounded by a longitudinal straight end edge 90 that extends substantially parallel to the outside straight end edge 87 of the straight portion 85, a lateral straight end edge 92 that extends substantially parallel to a straight end edge 91 that extends in a protruding direction of the protruding portion 86, and that is orthogonal to the longitudinal straight end edge 90, and a circular-arc-shaped end edge 93 that extends the outer periphery of the fixed contact 31. In addition, the lateral straight end edge 92 of the second conductive portion 82 and the lateral straight end edge 92 of the fourth conductive portion 84 are biased by only the same dimension AL from a virtual straight line A-A that passes through the contact center O-1 and is orthogonal to the straight portion 85.

The second conductive portion 82 is arranged via an L-shaped gap 94 outside the first conductive portion 81, and the fourth conductive portion 84 is arranged via the L-shaped gap 94 outside the third conductive portion 83, and the second conductive portion 82, the fourth conductive portion 84, and the L-shaped gap 94 are arranged point-symmetrically about the contact center O-1.

As shown in FIG. 10B, the L-shaped gap 94 is composed of a longitudinal gap 95 that is provided between the outside straight end edge 87 and the longitudinal straight end edge 90, and extends parallel to he I-shaped gap 88, and a lateral gap 96 that is provided between the protruding straight end edge 91 and the lateral straight end edge 92, and extends in the direction orthogonal to the longitudinal gap 95. By shifting the lateral straight end edge 92 from the virtual straight line A-A as mentioned above, the longitudinal gap 95 also extend slightly beyond the virtual straight line A-A, and is connected to the lateral gap 96.

In this way, as showing in FIG. 10B, a distance θ1 from an open end 97 of the I-shaped gap 88 to an open end 98 of the lateral gap 96, and a distance θ2 from the open end 98 of the lateral gap 96 to an open end 99 of the longitudinal gap 95 become almost equal (θ1 θ2). This is because the open end 99 is shifted counterclockwise with respect to a straight line orthogonal to the virtual straight line A-A, but the open end 98 is similarly shifted counterclockwise.

As the fixed contact 31 according to this embodiment, as shown in FIG. 10A, at the outer peripheral portion of the fixed contact, the protruding portion 86 of the first conductive portion 81, the second conductive portion 82, the other end 87 of the first conductive portion 81, the protruding portion 86 of the third conductive portion 83, the fourth conductive portion 84, and the end 87 of the third conductive portion 83 are arranged sequentially in a peripheral direction at predetermined gaps, respectively, and the first conductive portion 81 and the fourth conductive portion 84 are connected electrically, and the second conductive portion 82 and the third conductive portion 83 are connected electrically, and are thus formed so that they may be electrically connected alternately.

In this embodiment, the width of the I-shaped gap 88 and the width of L-shaped gap 94 are the same dimension. In addition, a dotted circle shown in FIG. 10A represents the outline of the movable contact 30, and the movable contact 30 is designed so as to have a smaller diameter than the fixed contact 31 to provide a difference in dimension so that the outer peripheral edge of the movable contact 30 may positively contact the fixed contact 31 inside the fixed contact. That is, as a measure for the switch being not turned on in a case where the movable contact 30 is inclined, the end of an outer periphery of the movable contact first contacts the fixed contact 31. Thus, the shape of the fixed contact 31 that is further inside than the contact position becomes mainly more important.

FIGS. 11A and 11B are views for explaining the arrangement of a fixed contact group used for the mirror switch, FIG. 11A is a view showing the arrangement pattern of the fixed contact group, and FIG. 11B is a view showing an indicating surface of an upper operating body, and showing the relationship between the direction of an indicating portion, and the direction of a fixed contact.

In this embodiment, as shown in FIG. 11A, first to eighth eight fixed contacts 31 are provided. As the arrangement pattern of these fixed contacts 31, the fixed contacts are provided line-symmetrically with respect to an imaginary line X-X that passes through a tilting centerline O of the operating body, and are provided line-symmetrically with respect to an imaginary line Y-Y that passes through the tilting centerline O.

Also, two adjacent fixed contacts 31 becomes a pair, that is, a first fixed contact 31*a* and an eighth fixed contact 31*h*, a second fixed contact 31*b* and a third fixed contact 31*c*, a fourth fixed contact 31*d* and a fifth fixed contact 31*e*, and a sixth fixed contact and 31*f* and a seventh the fixed contact 31*g* become pairs, respectively, thereby providing fourth sets.

Also, both the I-shaped gap 88 and the longitudinal gap 95 in each fixed contact 31 of the first fixed contact 31*a* and the eighth fixed contact 31*h* turn to the same direction as the tilting direction (arrow direction of the indicating portion 8) of the operating body when the first indicating portion 8*a* is pressed down. Also, both the lateral gaps 96 in each fixed contact 31 turn to a direction orthogonal to the tilting direction (arrow direction of the indicating portion 8) of the operating body when the first indicating portion 8*a* is pressed down.

In a case where the operating body is tilted in the arrow direction of the first indicating portion 8*a* (the possibility that the operating body is tilted in this direction is the highest) by pushing the first indicating portion 8*a* from right above the first indicating portion, the movable contact 30 and the fixed contact 31 are able to contact each other, thereby reliably detecting the pressing in two places between the other end 87 of the first conductive portion 81, and the second conductive portion 82, and between the other end 87 of the first conductive portion 81 and one end of the third conductive portion 83, which are separated by the I-shaped gap 88 and longitudinal gap 95, which are shown in FIG. 10.

Further, in a case where the operating body is tilted in the pressing direction thereof by pressing a place slightly shifted to the right or left from right above the first indicating portion 8*a*, the movable contact 30 and the fixed contact 31 are able to contact each other, thereby detecting the pressing in either between the other end 87 of the first conductive portion 81, and the second conductive portion 82, or between the other end 87 of the first conductive portion 81 and one end of the third conductive portion 83.

Moreover, in a case where the operating body is tilted in the pressing direction thereof by pressing a place slightly shifted to the right or left from right above the first indicating portion 8*a*, the movable contact 30 and the fixed contact 31 are able to contact each other, thereby detecting the pressing either between the protruding portion 86 of the first conductive portion 81, and the second conductive portion 82 or between the protruding portion 86 of the third conductive portion 83, and the fourth conductive portion 84, which are separated by the lateral gap 96 shown in FIG. 10.

Such relationship of the direction (the arrangement direction) of the fixed contact 31 to the tilting direction of the operating body is also the same in other fixed contacts 31*b* to 31*g*.

As for the arrangement state of the fixed contact 69 used for the power window switch, as shown in FIG. 6, the relationship of the direction (the arrangement direction) of the fixed contact 69 with respect to the tilting direction of the switch driving body 43 is the same as that of the above-mentioned mirror switch, and the duplicate description is omitted accordingly.

In this embodiment, a fixed contact having a circular planar shape has been described. However, the invention is limited thereto, and the planar shape may be other shapes, such as an oval shape, an elliptical shape, and a rectangular shape.

In this embodiment, a switch used for a vehicle-mounted apparatus, such as a mirror switch or a power window switch has been described as an example. However, the invention is not limited to thereto, and can also be applied to switches used for other technical fields, such as information processing apparatus.

In this embodiment, two gaps are located in directions in which the movable contact is easy to incline by its structure. However, the invention is not limited thereto, and may be applied even to a type that moves vertically because the movable contact is inclined some or less. In that case, it is preferable that the positions of the open end 99 and the open end 98 are set to positions that have rotated slightly in the left direction, and the angle between the upper open end of the I-shaped gap 88 and the open end 99, and θ1 and θ2, which are shown in FIG. 10B, are set to the same value.

The invention claimed is:

1. A fixed contact pattern in which a conductive portion constituting a fixed contact is divided by a plurality of gaps, wherein the gaps include:

an I-shaped gap that passes through the center of the fixed contact, and that has open ends, which are open towards both sides of the fixed contact, at both ends thereof, and L-shaped gaps formed by connecting longitudinal gaps that are located on both sides of the I-shaped gap and extend substantially parallel to the I-shaped gap, and lateral gaps that extend in a direction orthogonal to the longitudinal gaps, wherein the longitudinal gaps extend beyond a virtual straight line A-A that passes through the center of the fixed contact and extend in the direction orthogonal to the I-shaped gap, and are connected to the lateral gaps, and wherein the L-shaped gaps are arranged point-symmetrically about the center of the fixed contact.

2. The fixed contact pattern according to claim 1, wherein a distance θ1 from an open end of the I-shaped gap to an open end of the lateral gap of each of the L-shaped gaps, and a distance θ2 from the open end of the lateral gap to an open end of the longitudinal gap of each of the L-shaped gaps are approximately equal to each other.

3. A switch device comprising a fixed contact and a movable contact provided so as to be brought into contact with or separated from the movable contact, the movable contact contacting the fixed contact while being tilted almost in the same direction, wherein the pattern of the fixed contact having a conductive portion constituting the fixed contact divided by a plurality of gaps, wherein the gaps include:

an I-shaped gap that passes through the center of the fixed contact and that has open ends, which are open towards both sides of the fixed contact, at both ends thereof, and L-shaped gaps formed by connecting longitudinal gaps that are located on both sides of the I-shaped gap and extend substantially parallel to the I-shaped gap, and lateral gaps that extend in a direction orthogonal to the longitudinal gaps, wherein the longitudinal gaps extend beyond a virtual straight line A-A that passes through the center of the fixed contact and extend in the direction orthogonal to the I-shaped gap, and are connected to the lateral gaps, and wherein the L-shaped gaps are arranged point-symmetrically about the center of the fixed contact.

4. The fixed contact pattern according to claim 1, wherein the conductive portion constituting the fixed contact has four fixed contacts, and the fixed contacts are formed so as to be electrically connected alternately.

5. The switch device according to claim 3, wherein the conductive portion constituting the fixed contact has four fixed contacts, the fixed contacts are formed so as to be electrically connected alternately, and the adjacent fixed contacts are shorted by the movable contact.

6. The switch device according to claim 3, wherein the fixed contact pattern is arranged so that the open end of the I-shaped gap and the open end of the longitudinal gap of each of the L-shaped gaps, which are arranged parallel to each other, in the fixed contact pattern, may turn to the tilting direction of the movable contact.

7. The switch device according to claim 6, further comprising an operating body that is tilted, a casing that holds the operating body, and a switch driving body that is inserted into a supporting and guiding portion provided in the casing with a gap, and is guided and moved downward by the supporting and guiding portion by the tilting of the operating body, an elastic sheet that is pressed against switch driving body and in which the fixed contact is formed, wherein the switch driving body moves downward with the tilting of the operating section body, and the movable contact contacts the elastic sheet in an inclined state, thereby tilting the movable contact.

8. The switch device according to claim 6, further comprising an operating body, a pair of fixed contacts, a pair of movable contacts that contact the fixed contacts, respectively, and an elastic sheet in which the movable contacts are formed, and a switch driving body that is arranged between the operating body and the elastic sheet body, wherein the switch driving body is inclined and the movable contacts formed in the elastic sheet are tilted, by pushing the portion of the switch driving body corresponding to a position biased from an intermediate position of the pair of movable contacts by an operating member, or changing the buckling strength of the elastic sheet.

9. The switch device according to claim 3, wherein the movable contact is formed with a substantially flat surface.

* * * * *

UNITED STATES PATENT AND TRADEMARK OFFICE

CERTIFICATE OF CORRECTION

PATENT NO. : 7,528,338 B2
APPLICATION NO. : 12/102391
DATED : May 5, 2009
INVENTOR(S) : Ryuji Ataka It is certified that error appears in the above-identified patent and that said Letters Patent is hereby corrected as shown below:

On the Title Page

Item (54), after "FIXED" delete "CONTRACT" and substitute --CONTACT-- in its place.

In the Specification

In column 1, line 1, after "FIXED" delete "CONTRACT" and substitute --CONTACT-- in its place.

Signed and Sealed this

Eighteenth Day of August, 2009

David J. Kappos

David J. Kappos
*Director of the United States Patent and Trademark Office*